US005163672A

United States Patent [19]

Mennie

[11] Patent Number: 5,163,672

[45] Date of Patent: Nov. 17, 1992

[54] BILL TRANSPORT AND STACKING MECHANISM FOR CURRENCY HANDLING MACHINES

[75] Inventor: Douglas U. Mennie, Barrington, Ill.

[73] Assignee: Cummins-Allison Corp., Mt. Prospect, Ill.

[21] Appl. No.: 745,490

[22] Filed: Aug. 15, 1991

[51] Int. Cl.[5] ..... B65H 29/40

[52] U.S. Cl. ..... 271/187; 271/188; 271/209; 271/315

[58] Field of Search ..... 271/188, 209, 187, 315

[56] References Cited

U.S. PATENT DOCUMENTS 4,345,754 8/1982 Willenbring ..... 271/209

4,732,375 3/1988 Tetherton ..... 271/209 X

*Primary Examiner*—Richard A. Schacher

*Attorney, Agent, or Firm*—Arnold, White & Durkee

[57] ABSTRACT

An improved bill transport and stacking mechanism is provided for currency handling machines and is adapted for efficient transport and stacking of curled currency bills, documents and the like. The bill transport path is provided with members for exerting transverse bending forces on opposed side edges of a bill immediately before the bill moves away from positive contact with the transport path surface. The transverse bending forces effectively "stiffen" the leading longitudinal bill edge so as to counteract any tendency the bill has to curl away from sustained contact with the transport path. The arrangement prevents curled bills from conforming to their original curled shape and forces such bills to be positively relayed from the bill transport path onto stacker blades positioned immediately downstream thereof.

5 Claims, 6 Drawing Sheets

BILL TRANSPORT AND STACKING MECHANISM FOR CURRENCY HANDLING MACHINES

BACKGROUND OF THE INVENTION

1. Field of the Invention

The present invention relates, generally to apparatus for handling documents, currency bills and the like. More particularly, this invention relates to an improved bill transport and stacking mechanism for use with document handling machines such as currency recognition units which are capable of automatic discrimination and counting of currency bills of different denominations.

2. Description of the Related Art

Automated currency handling systems have undergone rapid advancement in recent years, with respect to both sophisticated recognition techniques as well as the mechanical apparatus and physical configuration specifically adapted for implementing the increasingly advanced recognition and counting schemes. Top-of-the-line currency recognition units ("CRUs") are presently available which are capable of identifying and discriminating between and automatically counting multiple currency denominations at extremely high speeds.

Currency discrimination in modern-day CRUs is generally accomplished by optical sensing based on detecting and analyzing variations in light reflectance or transmissivity characteristics which occur when a currency bill is illuminated and scanned by a finely-defined strip of focused light. The subsequent currency discrimination is based on the generation and comparison of sensed test characteristic patterns with prestored master characteristic patterns for different currency denominations.

One exemplary and particularly advanced currency recognition unit (CRU) apparatus is disclosed in Raterman et al. U.S. patent application Ser. No. 07/475,111, filed Feb. 5, 1990, entitled "Method and Apparatus for Currency Discrimination and Counting", assigned to CumminsAllison Corporation, the entity to whom all patent rights in the present application are also assigned; the disclosure in that application is incorporated in its entirety herein by reference.

In a CRU system of the type disclosed in the above-noted Raterman et al. application, currency bills positioned at a bill accepting station are acted upon by a bill separating station which separates one bill at a time for being sequentially relayed by a bill transport mechanism, according to a precisely predetermined transport path, across an optical scanhead where reflectance characteristics of the bill are studied. Scanned bills are then transported to a bill stacking station where processed bills are sequentially stacked for subsequent removal.

The transport path is implemented in the form of a tri-sectional unit including an input path where bills are moved along a first direction in a substantially flat position, a curved guideway where bills are accepted from the input path and guided in such a way as to change the direction of travel to a second different direction, and an output path where bills are moved in a flat position along the second different direction across currency discrimination means located downstream of the curved guideway. At the end of the transport path, the CRU system is provided with a platform surface adapted to accept currency bills processed through the currency discrimination means for being delivered to a stacker plate where processed bills are stacked.

Typically, the stacker platform includes an angular surface on which are disposed a pair of stacker wheels which are formed of flexible blades and are supported for rotational movement in such a way that the blades of the stacker wheels cooperate with the stacker platform to pick up currency bills delivered thereto and deliver such wheels to the stacker plate.

Under operating conditions, a currency bill which is delivered to the stacker platform is picked up by the flexible stacker blades and becomes lodged between a pair of adjacent blades which, in combination, define a curved enclosure which decelerates the entering bill and function as means for supporting and transferring the bills from the stacker platform onto the stacker plate as the stacker wheels rotate.

CRU systems of the above-summarized type function efficiently with standard, normal currency which is not unduly curled. However, where currency bills being processed have been substantially curled, for various reasons including the manner in which bill stacks are handled by users, bank tellers, and the like, significant problems are encountered in efficiently transporting processed bills from the output end of the transport path to the stacker wheels and, hence, onto the stacker plate.

More specifically, as a curled document or currency bills goes through the CRU transport path, it is held flat against the action of some form of belt/roller bias arrangement so that the curling action of the bill is effectively countered. However, as the bill makes the transition from the end of the transport path to the stacker platform, the leading edge of the bill remains unrestrained for the transitional distance between the end of the transport path and subsequent contact with the flexible blades on the stacker wheels. In the absence of any flattening restraint exerted upon the bill, as it leaves the transport path the curled bill, immediately begins to conform to its original curled shape. As a result, the bill is likely to curl away from the stacker platform so that the leading edge of the bill is totally prevented from making any contact with the stacker wheels. Accordingly, such bills are never received by the stacker wheels and "fly" out of the CRU apparatus.

There, accordingly, exists a need for provision of means adapted for use with conventional CRU systems which are capable of counter-acting the inherent curling action associated with substantially curved bills and the like, so that effective stacking of curled bills may be realized by insuring controlled transfer of currency bills from the transport path to the stacker wheels and the stacker plate.

SUMMARY OF THE INVENTION

It is a principal object of the present invention to provide an improved bill transport and stacking mechanism for currency handling machines or CRU systems.

A related object of this invention to provide an improved method and apparatus of the above type which can be conveniently incorporated into conventional CRU systems to render them capable of effectively stacking curled bills, documents or the like.

A related object of the present invention is to provide such an improved bill transport and stacking mechanism which is compact, economical, and simple in construction and operation.

Briefly, in accordance with the system of the present invention, the above-enumerated objectives are realized by means of an improved bill transport and stacking mechanism which is particularly adapted for controlled and restrained transfer of curled bills or the like from the end of the bill transport path into direct contact with the stacker blades positioned downstream of the transport path. According to a feature of the present invention, the bill transport path is provided with means for exerting a transverse bending force on the leading side edges of a processed currency bill about the point along the bill transport path where the bill typically moves away from positive contact with the transport path surface. This transverse bending force is applied to the opposite side edges in such a way as to "stiffen" the leading longitudinal bill edge and temporarily, yet effectively, counteract any tendency the bill may have to curl away from sustained contact with the transport path. The end result is that even curved bills are prevented from reverting or conforming to their original curled shape as the bills are relayed from the bill transport path onto the stacker blades positioned immediately downstream thereof.

In accordance with a preferred embodiment of the present invention, a pair of coning blocks are positioned about the end of the bill transport path in such a way as to be disposed opposite each other at positions adapted to contact opposing side edges of a processed currency bill being transported therethrough. Preferably, the counting devices are disposed in line with the opposed, counter-rotating transport rollers functioning as the final means for positively restraining the bill about the bill transport path. The coning blocks effectively bend the leading side edges of a bill processed therethrough in such a way as to "flatten" the leading longitudinal edge of the bill. Accordingly, any curling of the bill away from the bill transport path is resisted and curled bills are transported in a controlled and restrained manner from the end of the bill transport path onto the downstream stacker blades.

According to an alternative embodiment of the present invention, the requisite transverse bending force is applied to the leading bill edges by means of a rib/groove arrangement wherein the final transport roller along the transport path is provided with at least two outwardly projecting ribs at locations where the transverse bending force needs to be applied to the bill side edges. The sections of the transport path immediately opposing the roller ribs are provided with a groove or slot so that, under operating conditions, bills are "pinched" between the rib/groove combination and the corresponding sections of a bill positioned therebetween have a bending force applied thereto; the end result, again, is to "stiffen" the leading longitudinal edge of the bill and temporarily counteract any bill curling.

According to another alternative embodiment, the requisite "pinching" of bills relayed through the transport path is realized by the provision of an O-ring on the upper transport roller along with a corresponding slot in the transport path so that processed bills have their leading edges "stiffened" as they move between the ring/slot combination.

BRIEF DESCRIPTION OF THE DRAWINGS

Other objects and advantages of the present invention will become apparent upon reading the following detailed description in conjunction with the drawings in which.

Figure 1:
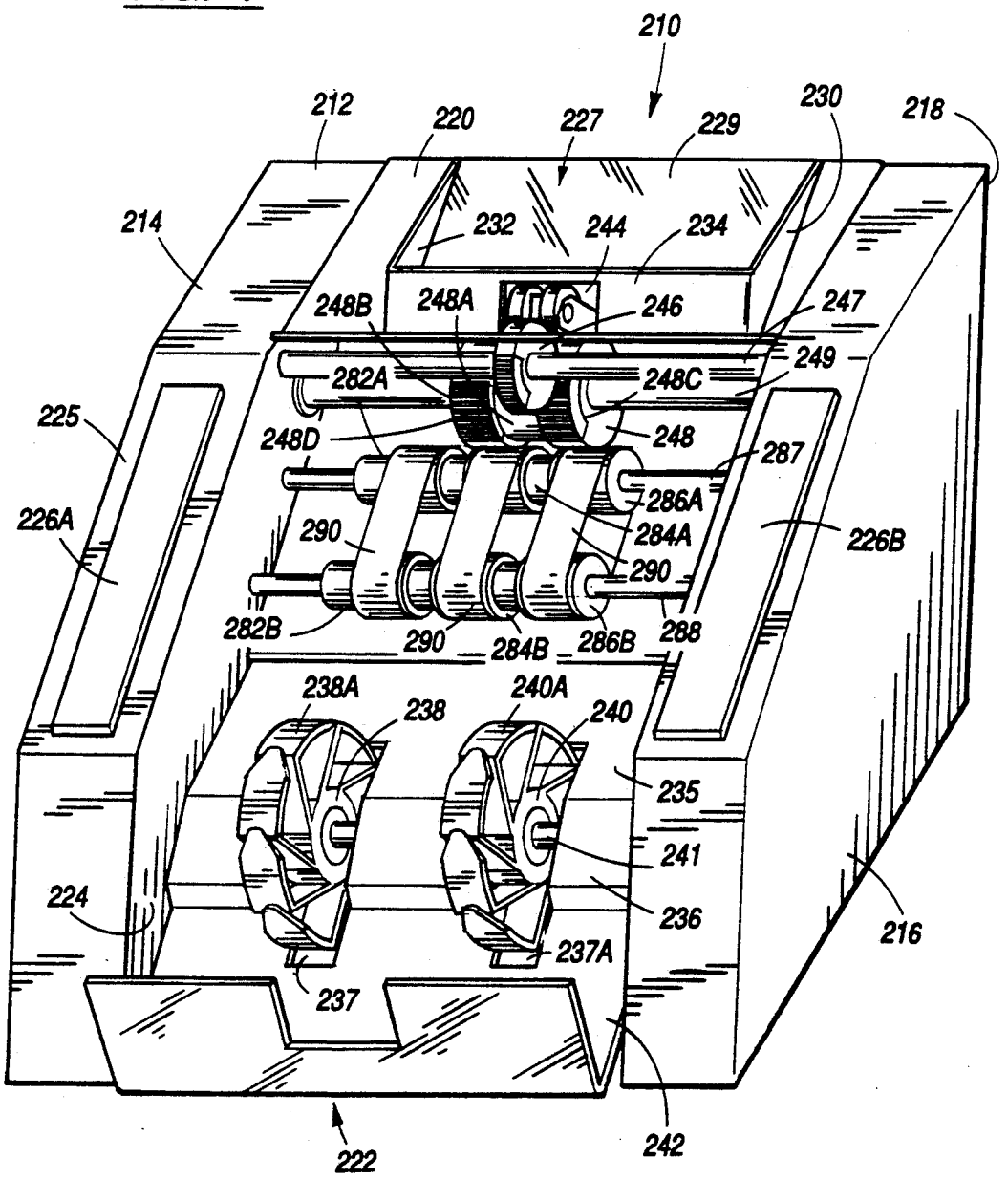
FIG. 1 is a perspective view of an exemplary CRU system for currency discrimination counting wherein the improved bill transport and stacking mechanism of this invention maybe advantageously incorporated.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
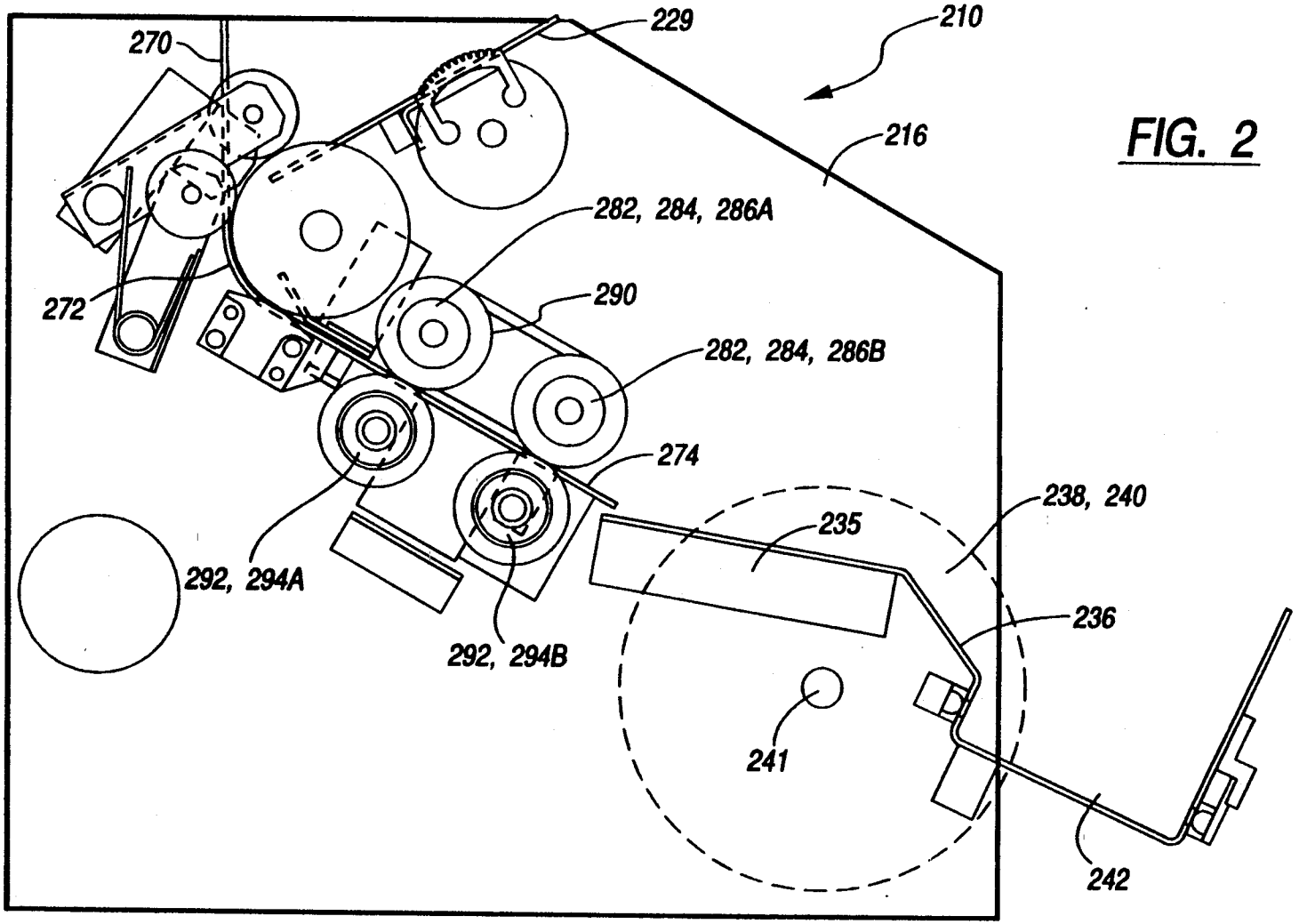
FIG. 2 is a side view of a CRU system disclosed in FIG. 1.

Referring now to the drawings, and more particularly to FIGS. 1 and 2, there are shown illustrations of an exemplary CRU system wherein the improved bill transport and stacking mechanism according to the present invention may be advantageously incorporated. It should be note that the illustration in FIG. 1 and the corresponding description set forth herein corresponds to the disclosure in the above-noted Raterman et al. patent application, and is utilized for illustrative purposes only. The bill transport and stacking mechanism disclosed and claimed herein by the applicant is particularly adapted for conveniently being used with CRU systems of this type; however, the transport/stacking mechanism may be advantageously used with most document handling systems wherein documents such as currency bills and the like are handled and relayed from a bill transport path onto a stacking platform and wherein the presence of bill curling can lead to loss of positive contact between the transport path and the stacking mechanism disposed downstream thereof.

Focusing on FIGS. 1 and 2, there is shown CRU apparatus 210 which comprises a housing 212 which includes left and right hand sidewalls 214 and 216, respectively, a rear wall 218 and a top surface generally designated as 220. The apparatus has a front section 222 which comprises a generally vertical forward section 224 and a forward sloping section 225 which includes side sections provided with control panels 226A and 226B upon which various control switches for operating the apparatus, as well as associated display means, are mounted.

For accepting a stack of currency bills 228 which have to be discriminated according to denomination, an input bin 227 is defined on the top surface 220 by a downwardly sloping support surface 229 on which are provided a pair of vertically disposed side walls 230, 232 linked together by a vertically disposed front wall 234. The walls 230, 232 and 234, in combination with the sloping surface 229, define an enclosure where the stack of currency bills 228 is positioned.

From the input bin, currency bills are moved along a tri-sectional transport path which includes an input path where bills are moved along a first direction in a substantially flat position, a curved guideway where bills are accepted from the input path and guided in such a way as to change the direction of travel to a second different direction, and an output path where the bills are moved in a flat position along the second different direction across currency discrimination means located downstream of the curved guideway. In accordance with the optical sensing and correlation technique disclosed in the Raterman et al. application, the transport path is defined in such a way that currency bills are accepted, transported along the input path, the curved guideway, and the output path, and stacked with the narrow dimension "W" of the bills being maintained parallel to the transport path and the direction of movement at all times.

The forward sloping section 225 of the document handling apparatus 210 includes a platform surface 235 centrally disposed between the side walls 214, 216 and is adapted to accept currency bills which have been processed through the currency discrimination means for being delivered to a stacker plate 242 where the processed bills are stacked for subsequent removal. The platform 235 includes an associated annular surface 236 and is provided with openings 237, 237A from which flexible blades 238A, 240A of a corresponding pair of stacker wheels 238, 240, respectively, extend outwardly. The stacker wheels are supported for rotational movement about a stacker shaft 241 disposed about the angular surface 236 and suspended across the side walls 214 and 216. The flexible blades 238A, 240A of the stacker wheels cooperate with the stacker platform 235 and the openings 237, 237A to pick up currency bills delivered thereto. The blades operate to subsequently deliver such bills to a stacker plate 242 which is linked to the angular surface 236 and which also accommodates the stacker wheel openings and the wheels projecting therefrom.

During operation, a currency bill which is delivered to the stacker platform 235 is picked up by the flexible blades and becomes lodged between a pair of adjacent blades which, in combination, define a curved enclosure which decelerates a bill entering therein and serves as a means for supporting and transferring the bill from the stacker platform 235 onto the stacker plate 242 as the stacker wheels rotate.

In the above-described type of CRU system, the bill transport path has an input path defined by the forward section of the sloping surface 2229 and includes a curved guideway 270 (see FIG. 2) for accepting currency bills that have been propelled forward along the input path. The guideway 270 includes a curved section 272 which corresponds substantially to the curved periphery of a capstan 248 which includes a roller arrangement for propelling stripped currency bills into the curved section 272. Downstream of the curved section 272, the bill transport path has an output path in the form of a section 274 along which bills which have been guided along the curved guideway 270 are moved along a direction which si relatively opposite to the direction along which bills are moved along the input path. A series of rollers are proved for positively guiding currency bills from the input bin along the input path, the curved guideway, and the output path this arrangement is disclosed in the detail in the above-noted Raterman et al. patent application and, since it is not directly pertinent to the subject invention, is not described in detail herein.

In the output path, currency bills are positively guided along the flat section 274 by means of a transport roller arrangement which includes a plurality of factually spaced, positively driven transport rollers 282A, 284A, 286A which are disposed on a transport shaft 287 supported across the sidewalls of the apparatus. The flat section 274 includes openings through which protrude at least two passive transport rollers 292A and 294A, which are mounted on a support shaft (not shown) supported between the sidewalls of the apparatus below the flat section 274 of the output path. The passive transport rollers are spring-loaded into counter-rotating contact with the active transport rollers and the points of contact are made coplanar with the output path so that currency bills can be moved along the path in a flat manner under the positive contact of the opposingly disposed active passive rollers.

A similar set of active transport rollers 282B, 284B, 286B and opposing spring-loaded passive transport rollers 292B, 294B are provided downstream of the first set of transport rollers at a distance which is somewhat short of the length of the narrow dimension of the currency bills that are to be discriminated.

In operation, currency bills propelled along the curved guideway section 272 are pulled into the flat section 274 of the output path by the counter-rotating action of the first set of transport rollers. This positive contact is maintained as the bills move along the flat section 274 and into the positive contact imparted thereupon by the counter-rotating movement of the second set of transport rollers. The disposition of the second set of transport rollers is such that the positive contact exerted thereby on a currency bill moving along the output path occurs before the bill is released from the positive contact between the first set of transport rollers. Accordingly, the second set of transport rollers positively guides a currency bill to the stacker platform 235 from where the stacker wheels 238, 240 pick up the bill and deposit it onto the stacker plate 242.

The above-described CRU system functions effectively in positively driving normal, uncurled currency bills along the input path, the curved pathway, and the flat section of the output path and out onto the stacker platform. This type of bill transport and stacking mechanism, however, faces severe problems when the currency bills being handled are substantially curled. Currency bills maybe curled due to a variety of reasons including the manner in which bill stacks are handled for counting, etc., by users, tellers and the like.

When curled bills are handled by the CRU system described above, the curling effect is effectively neutralized through most of the transport path because of the positive driving arrangement according to which bills are moved under restraining contact with the series of rollers provided along the input path, the curved guideway, and the flat section of the output path. More specifically, in the flat section 274 of the output path, the curling action is neutralized because of the positive driving imparted upon the bills by the first and second set of transport rollers and, in between the two sets of rollers, by the drive belts used to link the opposing sets of active transport rollers.

However, once a curled bill begins to move out of contact with the second set of transport rollers along the flat section 274 of the output path, the inherent curling of the bill can cause the leading longitudinal edges thereof to curl away from the plane of the straight section 274 and out of contact therewith. As a result, if the bill is sufficiently curled, the leading edges thereof can curl out to such an extent that the edges lose contact totally with the straight section 274 of the output path and are unable to contact the stacker platform 235. Accordingly, such bills totally miss the stacker wheels 238, 240 and can literally "fly" out of the CRU apparatus.

The above-noted problems associated with efficiently transporting and stacking curled documents, bills and the like are resolved, in accordance with the present invention, by provision of means for exerting a transverse bending force on the leading side edges of a curled bill as they move out of contact with the downstream transport rollers. The effect is to "stiffen" the leading edges so as to temporarily counteract any bill curving which would tend to move the leading edges away from contact with the flat portion 274 of the transport path. The application of this transverse bending force is preferably about opposed corners of the leading side edges of the currency bills and effectively forces any curled bills down into contact with the flat section 274 and subsequently into contact with the stacker platform 235 so as to be picked up by the stacker wheels 238, 240 in order to be transferred to the stacker plate 242.

An illustrative arrangement for application of the transverse bending force is shown in FIGS. 3–6, which provide illustrations of an improved bill transport and stacking mechanism, according to a preferred embodiment of the present invention. It should be noted that FIGS. 3–6 focus only upon the flat section of the output path for the bill transport path since that is the section where problems with transporting and stacking curled bills occur, and this is the section which is the focus of the present invention.

Referring collectively to FIGS. 3–6, the transport and stacking mechanism 300 shown therein includes the flat section 302 of the bill transport output path which is adapted to receive currency bills which have been guided along the curved guideway (not shown), as described above. The transport roller arrangement for positively guiding currency bills along the flat section 302 is also conventional and includes a first set of active transport rollers 304A, 304B supported on a transport shaft 305, and a corresponding set of passive transport rollers 306A, 306B supported on a second transport shaft 307. Downstream of the first set of transport rollers, a second set of active transport rollers 308A, 308B is supported on a transport shaft 309 and operate in counter-rotating contact with a corresponding set of passive transport rollers 310A, 310B which, in turn, are supported on a transport shaft 311. Positive contact of currency bills along the flat section 302 between the two sets of transport rollers is realized by linking the first and second sets of active transport rollers by a plurality of passively-driven linkage means such as "O"-rings 312.

Figure 3:
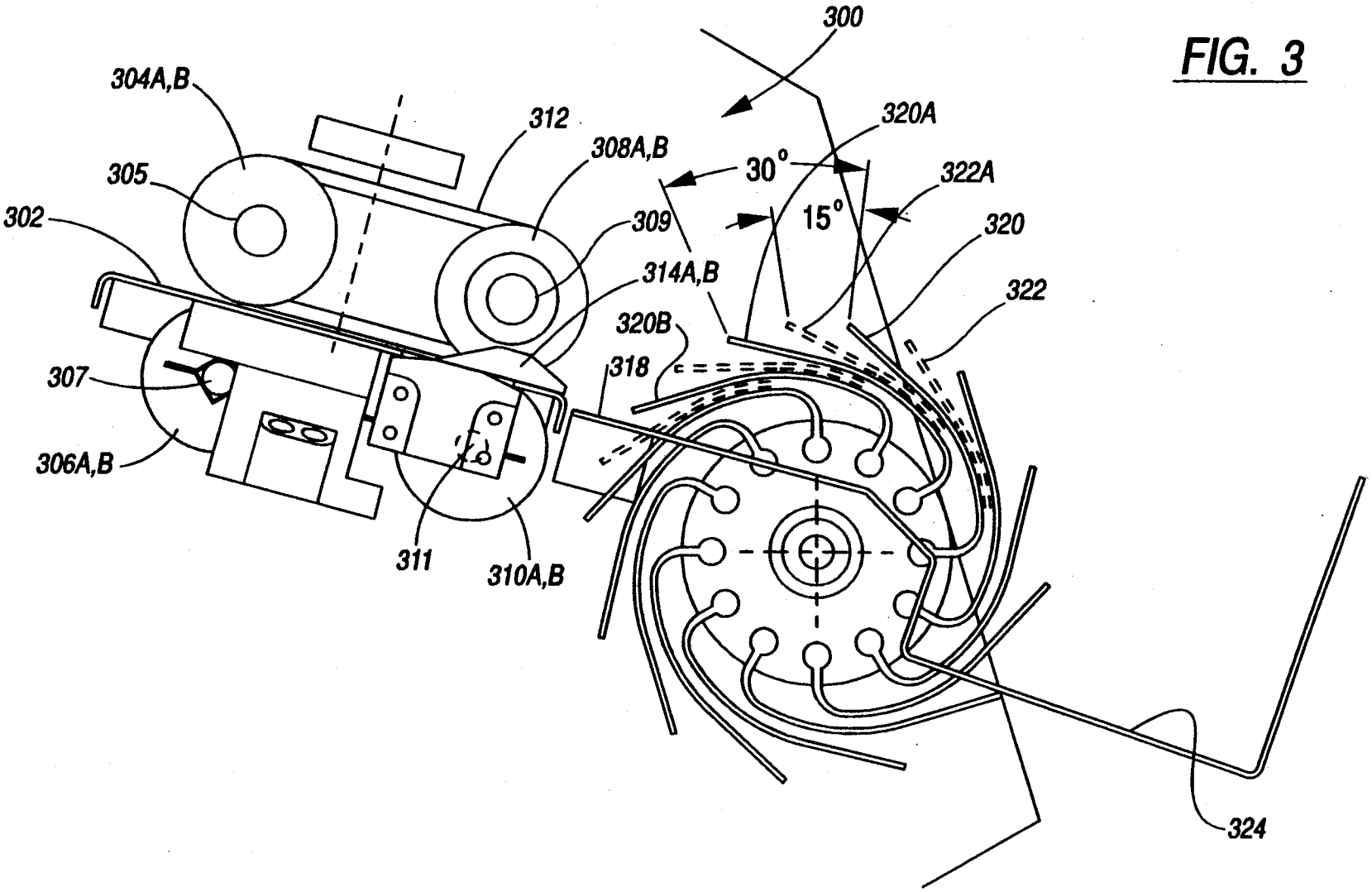
FIG. 3 is a side view illustrating the improved bill transport and stacking mechanism, in pertinent detail, according to a preferred embodiment of the present invention.
Figure 4:
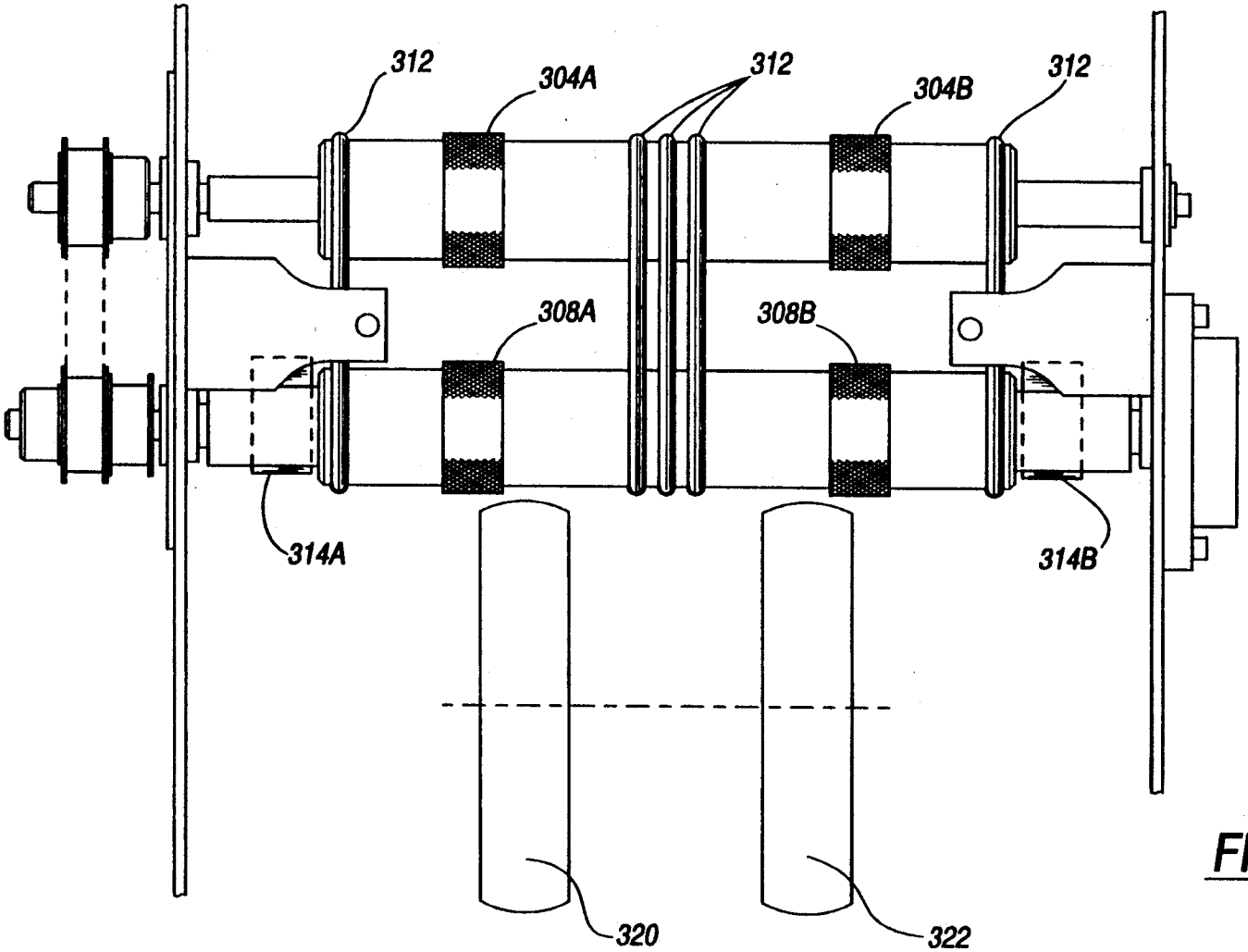
FIG. 4 is a top view of the bill transport and stacking mechanism illustrated at FIG. 3.
Figure 5:
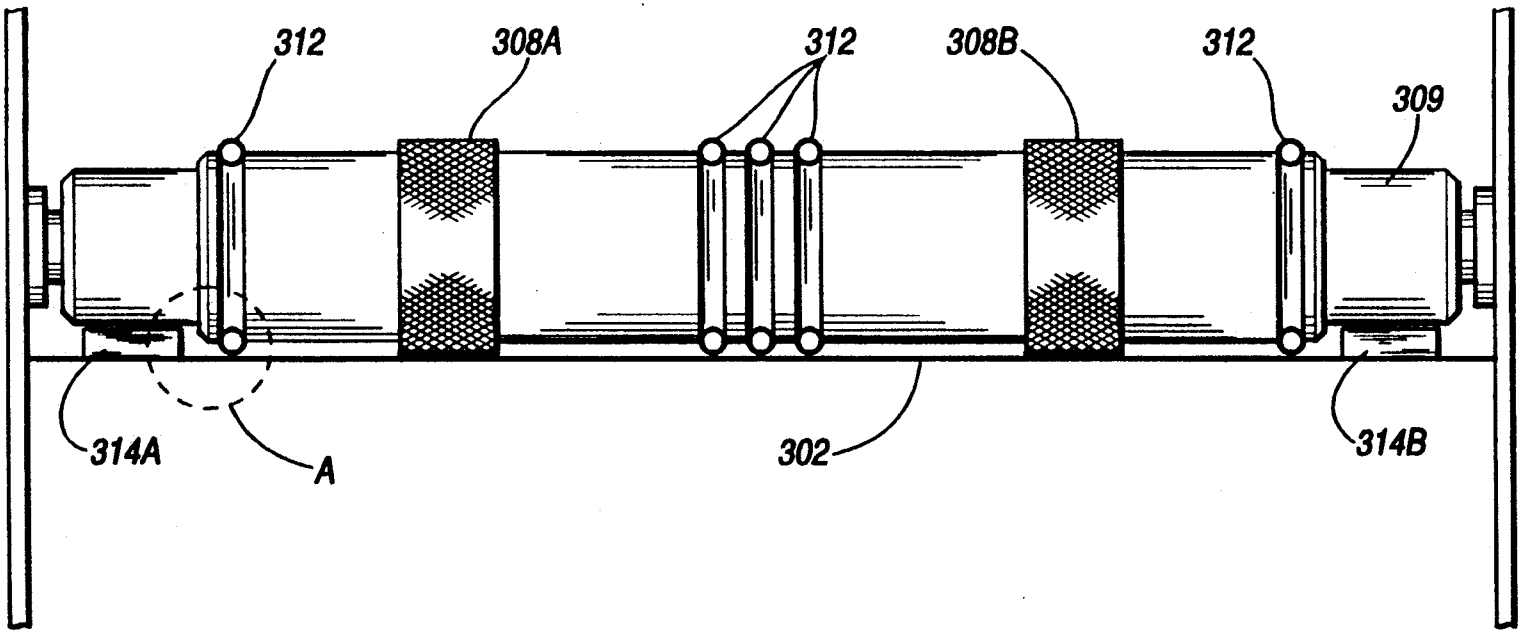
FIG. 5 is a partial side view illustrating the manner in which the transverse bending forces are applied to the leading longitudinal edges of a currency bill in order to counteract bill curling, according to the present invention.
Figure 6:
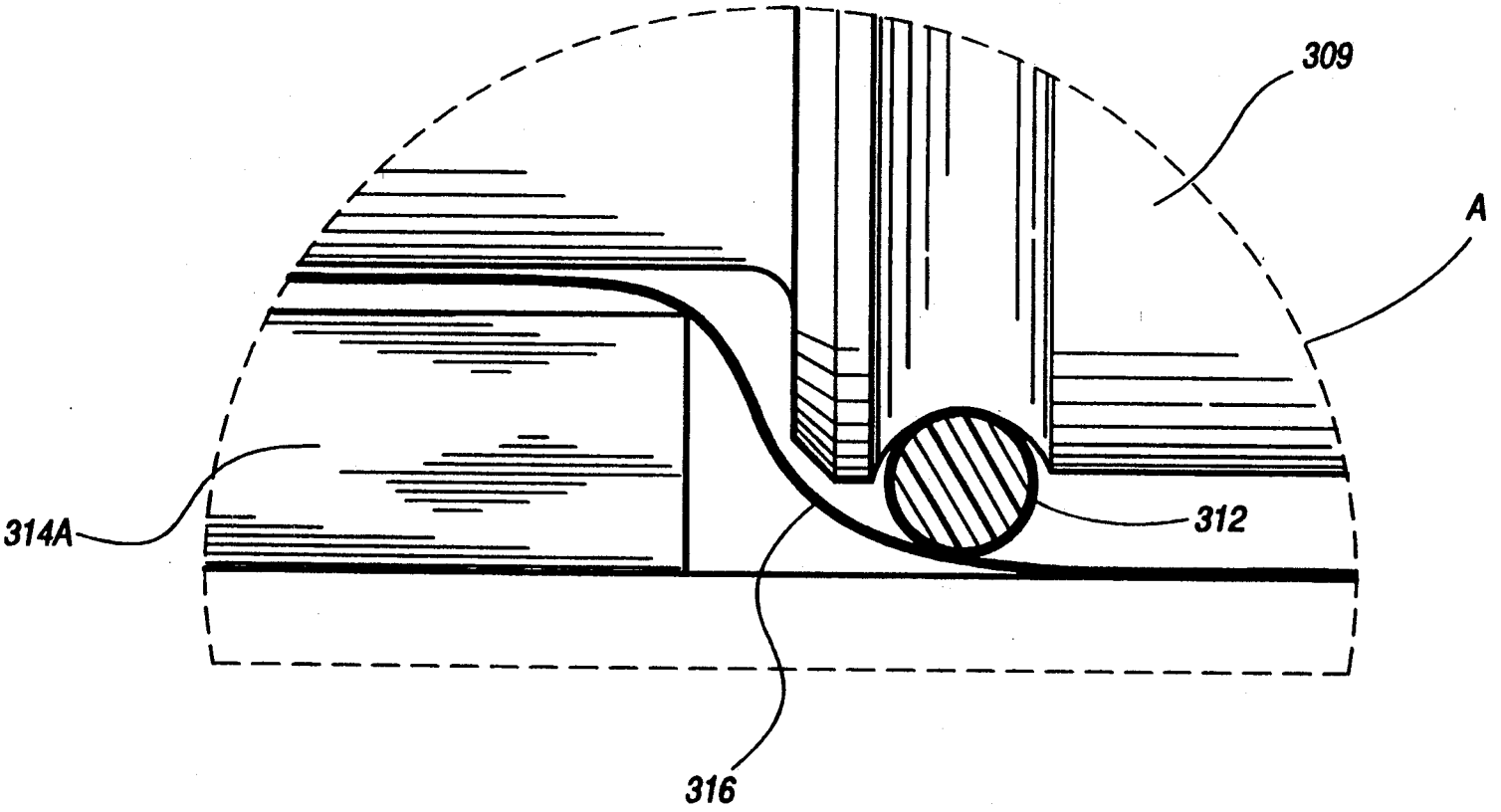
FIG. 6 is a segmented enlarged illustration of the interaction between the coning blocks and a currency bill coming into contact therewith.

The application of the transverse bending forces necessary for counteracting bill curling as bills leave the positive contact exerted by the downstream set of transport rollers is realized by means of a pair of coning blocks 314A, 314B. As best seen in FIGS. 3 and 5, the coning blocks 314A and B are positioned upon the flat section 302 of the bill output path in such a way as to be clear of the rotating action of the active transport rollers 308A, 308B. However, the coning blocks 314A, 314B are opposingly disposed by a distance such that each of them positively contacts opposed leading side edges of a currency bill as it is acted upon by the counter-rotating action of the active transport rollers 308A, 308B with the corresponding passive transport rollers 310A, 310B. Preferably, the coning blocks 314A, 314B are disposed so as to extend perpendicularly on the straight section 302 of the output transport path in line with the axis of the transport shaft 309 which supports the active transport rollers 308A, 308B.

With the arrangement described above, a currency bill which is acted upon by the downstream transport rollers 308A, B is positively driven by the rollers as well as the associated O-rings 312. At the opposed corners of the leading side edges of such a bill, each of the coning blocks positively contacts the portion of the bill extending transversely from the active transport rollers (see the enlarged view of FIG. 6). This positive contact exerts a transverse bending force upon such a bill 316 which "stiffens" the leading longitudinal edge thereof effectively counteracts any tendency of the bill to curl away from the flat section 302. This application of transverse bending force through the coning blocks effectively "bends" the two side edges of a bill which, in turn, "stiffens" or "flattens" the leading longitudinal edge of the document, thereby allowing it to be positively accepted by the downstream stacker wheels. The end result is to greatly enhance the ability of the CRU apparatus to stack curled bills or like documents. The combined exertion of the transverse bending forces by the coning blocks 314A and 314B, thus, effectively forces any curled bill downwardly toward the flat section 302 and subsequently toward the stacking platform 318 disposed downstream of the bill transport path. Accordingly, even curled bills are forced into contact with the stacker wheels 320, 322 disposed on the stacker platform 318 so as to be positively contacted therewith and stacked onto the stacker plate 324.

It should be noted that the above-described arrangement can be conveniently incorporated into existing CRU apparatus by modifying the flat section of the bill transport path in such a way as to accommodate the coning blocks 314A, 314B without interfering with the rotation of the downstream transport rollers. It will be understood by those skilled in the art having the benefit of this disclosure that alternative means maybe employed for exerting the requisite transverse bending force on opposed corners of the leading bill edges in order to counteract the effect of bill curling.

As an illustrative example, the transport shaft corresponding to the downstream transport rollers itself may be configured to include means for exerting such forces at portions extending beyond the transport rollers themselves. For instance, an outwardly extending rib maybe provided on such extending transport shaft sections for positively contacting the extending sections of a currency bill (about the side edges thereof) in cooperation with a corresponding groove or slot provided on an opposing portion of the flat section of the output path. Alternatively, the extending sections of the transport shaft maybe modified by an appropriately sized O-ring for providing the positive contact on the extending bill sections in cooperation with a corresponding slot in the flat portion of the output path.

In accordance with an additional feature of the present invention, efficient stacking of bills relayed to the stacking platform 318 (see FIG. 3) is further improved by positioning the stacker wheels 320, 322 relative to each other in such a way that the corresponding flexible stacker blades on one wheel are angularly displaced relative to blades on the other wheel, thereby effectively realizing relative interleaving of the blades on the stacker wheels . More specifically, as shown in FIG. 3, the stacker wheels 320, 322 are permanently positioned to incorporate a "staggered" angular blade displacement, relative to the two stacker wheels. For instance, from any reference position relative to the side view of FIG. 3, the angular displacement between successive blades on the stacker wheel 320 is selected to be different from that between blades for the other stacker wheel 322 so as to realize an effective interleaving of the stacker blades on the two stacker wheels.

In a preferred embodiment, the angular displacement between the edge of a blade 320A on the stacker wheel 320 and the edge of the following blade 320B on the same wheel was defined to be 30°. However, the edge of the blade 322A on the stacker wheel 322 which corresponds to the blade 320A on the stacker wheel 320 is positioned to be, not in alignment with that of blade 320A but, instead, displaced by a relative angle of 15°. With this type of arrangement, bill "fly over" as currency bills exit from the positive contact exerted thereupon by the downstream set of transport rollers is significantly reduced because bills which barely miss being contacted by a rotating blade on one of the stacker wheels is likely to be contacted immediately thereafter by a succeeding blade on the adjacent stacker wheel because of the relative angular displacement between the two blades. The arrangement is particularly adapted to prevent bill "fly over" when a CRU system is initially started up and is effective in maintaining positive stacking of bills with both curled as well as normal bills.

I claim:

1. In a document handling system for processing documents such as currency bills, the system including an input path for receiving currency bills to be processed along which bills may be moved along a first direction, an output path along which bills may be moved along a second direction, a curved guideway disposed between said input and output paths and for accepting bills from said input path and guiding them along said second direction onto said output path, and a pair of spacing wheels disposed downstream of the output path and spaced therefrom for receiving bills moving out of the output path and stacking them for subsequent removal, each of said stacking wheels having multiple flexible blades for capturing and holding successive bills from said output path, the improvement comprising means for exerting transverse bending forces on the leading opposite side edges of a processed bill before said bill moves away from contact with said output path and into engagement with said stacking wheels, said forces effectively stiffening the leading longitudinal edge of said bill so as to prevent said leading bill edge from moving away from said output path and said stacking wheels.

2. The improved document handling system according to claim 1 wherein said output path includes a flat section along which said bills are moved under positive contact against said output path by at least one transport roller mounted for rotation about a corresponding support shaft, said side edges of said bills having sections extending transversely on either side of said transport roller, said transverse bending forces being exerted by a pair of blocks disposed at positions adapted to counteract said extending sections of said opposing side edges of said bill, said forces being applied in a direction generally perpendicular to the direction of movement of said bill along said output path.

3. The improved document handling system according to claim 2 wherein said processed bills are substantially curled and have a tendency to curl away from said flat portion of said output path, and said transverse forces are applied in such a way that said stiffening of said leading longitudinal bill edge forces said edge toward said output and prevents it from curling away from subsequent contact with said stacking wheels.

4. The improved document handling system according to claim 3 wherein, said transverse forces are applied to said opposing leading sides edges at positions substantially in line with the axis of rotation of said transport shaft.

5. The document handling system of claim 1 wherein the blades of each of said stacking wheels are annularly offset from the blades of the other of said stacking wheels.

* * * * *